US008888522B2

(12) United States Patent
Schrader

(10) Patent No.: US 8,888,522 B2
(45) Date of Patent: Nov. 18, 2014

(54) ELECTRIC PLUG-IN CONNECTION SYSTEM

(75) Inventor: Andreas Schrader, Delbruck (DE)

(73) Assignee: Phoenix Contact GmbH & Co. KG, Blomberg (DE)

( * ) Notice: Subject to any disclaimer, the term of this patent is extended or adjusted under 35 U.S.C. 154(b) by 0 days.

(21) Appl. No.: 13/121,032

(22) PCT Filed: Sep. 25, 2009

(86) PCT No.: PCT/EP2009/006924

§ 371 (c)(1),
(2), (4) Date: Aug. 18, 2011

(87) PCT Pub. No.: WO2010/037505

PCT Pub. Date: Apr. 8, 2010

(65) Prior Publication Data

US 2011/0294361 A1 Dec. 1, 2011

(30) Foreign Application Priority Data

Sep. 30, 2008 (DE) ..... 10 2008 049 574

(51) Int. Cl.
*H01R 13/60* (2006.01)
*H01R 13/64* (2006.01)
*H01R 13/645* (2006.01)

(52) U.S. Cl.
CPC ..... *H01R 13/645* (2013.01); *H01R 13/6453* (2013.01); *H01R 13/6456* (2013.01); *H01R 13/64* (2013.01)
USPC ..... 439/353

(58) Field of Classification Search
CPC ..... H01R 13/6275
USPC ..... 439/353, 352, 358, 327, 326, 350, 939
See application file for complete search history.

(56) References Cited

U.S. PATENT DOCUMENTS

| | | | | |
|---|---|---|---|---|
| 4,376,565 | A | 3/1983 | Bird et al. | |
| 4,448,467 | A * | 5/1984 | Weidler | 439/80 |
| 4,790,763 | A | 12/1988 | Weber et al. | |
| 5,370,556 | A | 12/1994 | Olsson | |
| 5,865,651 | A | 2/1999 | Dague | |
| 6,383,032 | B1 * | 5/2002 | Gerberding | 439/681 |
| 6,419,515 | B1 * | 7/2002 | Okayasu | 439/358 |
| 6,918,783 | B2 * | 7/2005 | Endo et al. | 439/352 |

FOREIGN PATENT DOCUMENTS

| | | |
|---|---|---|
| DE | 195 00 156 | 7/1995 |
| EP | 0 128 307 | 12/1984 |
| EP | 0 235 339 | 9/1987 |

* cited by examiner

*Primary Examiner* — Phuongchi T Nguyen
(74) *Attorney, Agent, or Firm* — Greer, Burns & Crain, Ltd.

(57) ABSTRACT

An electric plug-in connecting system having at least one contact device and an electric plug-in connector for electrically connecting the electric plug-in connector with the contact device, and having a coding system to avoid unintentional contacts, wherein the coding system includes at least three coding devices independent of one another for coding.

14 Claims, 3 Drawing Sheets

ELECTRIC PLUG-IN CONNECTION SYSTEM

BACKGROUND

The present invention relates to an electric plug-in connecting system wherein pairs of electric components to be connected with one another can be connected by way of plugging in. The electric plug-in connecting system according to the invention may in particular be suited for connecting electric components each having a plurality of electric conductors.

Plug-in connecting systems have become known in the prior art wherein the plug-in connecting system components are coded so as to avoid incorrect contacting. A coding type has become known for example from DE 202 15 47 A for a plug-in connector consisting of a pair of coupling halves, one plug-in connector half comprising elements configured to be broken out which after removal expose openings into which the coding pins provided on the other of the plug-in connector halves can be inserted.

This known system has the disadvantage that coding is possible once only. Restoring to the original state is not possible since the element is broken out for coding. Furthermore only one characteristic, e.g. the polarity, can be coded.

SUMMARY

Against the background of the known prior art it is therefore the object of the present invention to provide a plug-in connecting system allowing more flexible coding.

The electric plug-in connecting system according to the invention comprises at least one contact device and at least one electric plug-in connector to electrically connect the electric plug-in connector with the electric contact device. Furthermore a coding system for avoiding unintentional contacts is provided. The coding system comprises at least three coding devices independent from one another for coding.

The electric plug-in connecting system according to the invention has many advantages. One considerable advantage of the electric plug-in connecting system according to the invention is the flexible coding option. The fact that three coding devices are available that are independent of one another allows performing a great variety of codings so as to enable flexible responses to requirements.

Particularly preferably at least one coding device is restorable so as to allow resetting specific coding settings optionally or as needed.

In a preferred more specific embodiment of the invention the coding system comprises at least one coding contour device as the coding device. The coding contour device is in particular formed by mated, asymmetric housing geometries of the tower socket of the contact device and of the tower of the electric plug-in connector.

A coding contour device operating via mated contours of the tower socket of the contact device and of the tower of the electric plug-in connector has considerable advantages since this reliably ensures a 180° orientation safeguard. One known error when plugging in plugs into master strips is inserting the plug rotated 180°. A coding contour device employing mated, asymmetric housing geometries helps to prevent insertion unintentionally rotated 180° since insertion will be prohibited due to the mated housing geometries unless correct orientation is given.

The tower socket of the contact device and/or the tower of the plug-in connector particularly preferably is non-symmetric in contour so as to obtain a reliable orientation safeguard in a simple way.

The tower of the plug-in connector is particularly preferably provided with a substantially rectangular outer contour comprising at least one coding chamfer. The coding chamfer may for example be provided as a beveled edge that is not angled 90° but has a bevel angle of e.g. 45° extending into the interior far enough to reliably prevent unintentionally rotated insertion of the plug-in connector into the contact device.

In a preferred more specific embodiment the coding system comprises at least one key and keyway coding device as one of the three coding devices. This key and keyway system is very advantageous since the keys and keyways interact to ensure reliable operation.

In particular, the key and keyway coding devices at the plug-in connector and at the contact device each comprise a coding key and at least one coding keyway. When the plug-in connector is inserted into the contact device the coding key of one of the parts comes into contact with the coding keyway of the other of the parts. In this way a plug-in connection of the plug-in connector with the contact device is allowed only when the matching coding key and coding keyway permit insertion. Given a coding prohibiting contact, the coding keyway will for example already terminate before the plug-in connector has been entirely pushed into the contact device. In this way an electric contact of the plug-in connector with the contact device is reliably prevented.

In a preferred more specific embodiment the plug-in connector and the contact device of the key and keyway coding device have identical numbers of coding keys and coding keyways. The dimensions of each of the coding keys and coding keyways then allow setting corresponding codings. For example the lengths of the coding keys and the lengths of the coding keyways along the direction of connection of the contact device and the plug-in connector may serve as coding.

In preferred more specific embodiments of all of the configurations described above the coding system comprises a coding profile device as another coding device. Their coding profile device comprises a coding socket and a coding profile that is in particular exchangeable. An exchangeable coding profile offers the considerable advantage of allowing flexible responses to currently prevailing requirements. For example when mounting successive electric plug-in connecting systems provided for different electric currents, an exchangeable coding profile allows simple and efficient coding of the electric current.

When employing these plug-in connecting systems according to the invention a great variety of different conditions may be given. For example the electric currents for which such an electric plug-in connecting system is designed may vary to a large extent. Thus, electric currents of 80 A or far higher electric currents of 100 A or more are possible. Or else, plug-in connecting systems are conceivable having electric currents of as little as 1 A or a few hundred mA. These different electric currents require different line cross-sections and other components adapted to the prevailing conditions. The invention presently provides a coding system having three or more coding devices independent from one another allowing flexible responses to all of the different conditions.

The coding profile device preferably comprises two or more coding sockets and at least one coding profile. Replugging the coding profile from one coding socket into another coding socket provides for simple coding of the electric plug-in connecting system.

For example it is conceivable for both the contact device and the plug-in connecting device to have a plurality of coding sockets each configured mated with one another such that as a plug-in connection is established the respective coding sockets are aligned with one another.

Given such a configuration it is preferred for the coding profiles to be plugged into the coding sockets to reliably prevent electric contacting of the contact device with the plug-in connecting device for example in the case that coding profiles are inserted into coding sockets corresponding to one another. When coding profiles are inserted into the respective mated coding sockets then the coding profiles may for example prevent the plug-in connecting device from being inserted farther into the contact device.

This type of flexible and individual coding offers flexibility in changing. Other than conceivable different electric currents an electric plug-in connecting system according to the invention may differ in their contacting materials in each case. For example different solders exist for contacting and for establishing solder joints. Silver solders or else tin solders may be employed. However, different metals at the contact surfaces may cause galvanic reactions inhibiting contact or even destroying the electric plug-in connecting system.

Therefore it is important to avoid contacting of different contact metals. For example if, in relation to the conditions of application in which the electric plug-in connecting system is employed or to the expected electric currents, different contact materials are used, then the coding profile device allows to obtain reliable and easy coding via one or more coding profiles.

On the whole any one of the three coding devices of the coding system enables coding the polarity so as to realize an orientation safeguard. A second contact device allows to code the provided electric current so as to only allow establishing plug-in connections in which the provided electric current remains within the provided range. The third coding device allows to code different metal surfaces to reliably avoid galvanic reactions of the contacting elements.

On the whole the invention provides a very simple system which via three coding devices operating independently from one another allows a very reliable and flexible coding.

Each of the elements or components of the electric plug-in connecting system may be provided with two or more coding sockets and at least one coding profile each.

A coding profile is preferably configured in a T-shape. When assembled as intended such a T-shaped coding profile preferably comprises a leg protruding out of a coding socket. By way of inserting a coded profile into a coding socket the electric plug-in connecting system can thus be coded restorable. For example if a new contact is connected with a contact device or an electric plug-in connection, then simple re-coding allows to adapt the plug-in connector or the contact device to the new conditions.

In all of the configurations the contact device is preferably configured as a master strip and the plug-in connector, as a plug. It is likewise possible for the contact device to be configured as a plug and the plug-in connector, as a master strip.

Further advantages and features of the invention can be taken from the exemplary embodiments described below with reference to the enclosed figures.

DETAILED DESCRIPTION

With reference to the FIGS. 1 to 6, two exemplary embodiments of the present invention will be discussed below.

Figure 1:
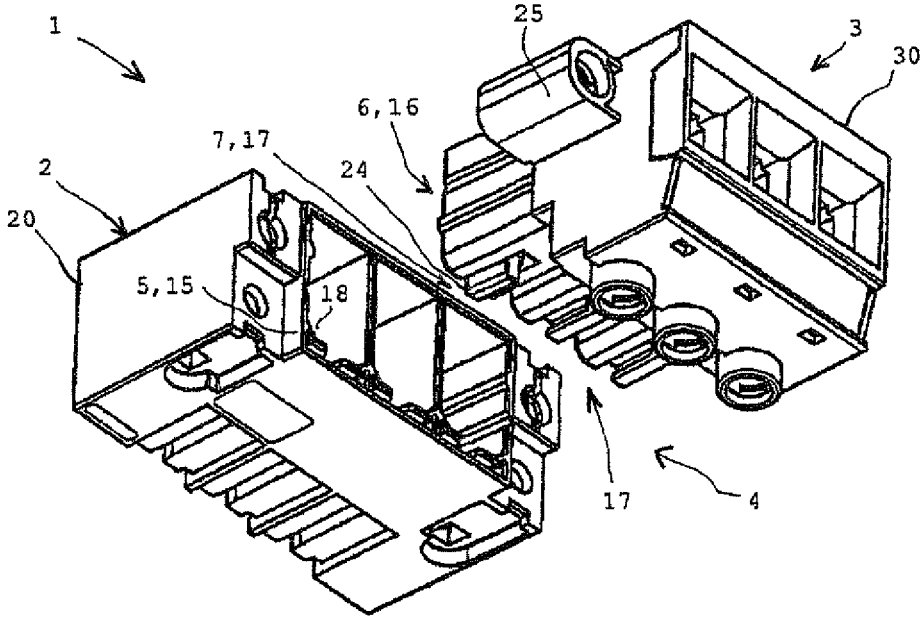
FIG. 1 a perspective overall view of an electric plug-in connecting system.

In FIG. 1 an electric plug-in connecting system 1 is illustrated in a perspective view which is presently provided with a contact device 2 configured as a master strip 20. Furthermore a plug 30 is provided configured as a plug-in connector 3 which serves for an electric connection with the contact device 2.

The electric plug-in connecting system 1 includes the contact device 2, and the plug-in connector 3, which form a coding system 4 including three coding devices 5, 6 and 7 independent from one another.

The first coding device 5, 15 is for example provided as an orientation safeguard to reliably prevent insertion rotated 180° of the plug-in connector 3 into the contact device 2. The housing geometries 8 and 9 are mated in their outer contours 12 and 13 to ensure an orientation safeguard.

A second coding device 6 in the shape of a key and keyway coding device 16 is provided for coding a second property. The second coding device 6 may for example serve for setting different electric currents. The coding device 6 or the key and keyway coding device 16 comprises coding keyways 22 and coding keys 21 which in the present exemplary embodiment extend on the surface of the tower 11 and the tower socket 10. Both the contact device 2 and the plug-in connector 3 are provided with coding keyways 22 and coding keys 21 such that one coding key 21 of a plug-in connector 3 correspondingly interacts with a coding keyway 22 of a contact device 2. The desired coding may be obtained by correspondingly configuring and dimensioning the coding keyways 22 and the coding keys 21.

The third coding device 7 is configured as a flexible coding profile device 17 provided with a plurality of coding sockets 23 and with coding profiles 24.

For example in the case of an electric contact device 2 having three electric contacts then each contact may be provided with one coding socket 23 which is provided for receiving a coding profile 24. Coding can be performed by inserting a coding profile 24 into respective coding sockets 23 so as to allow to reliably prevent a plug-in connection of unwanted contacts.

Figure 2:
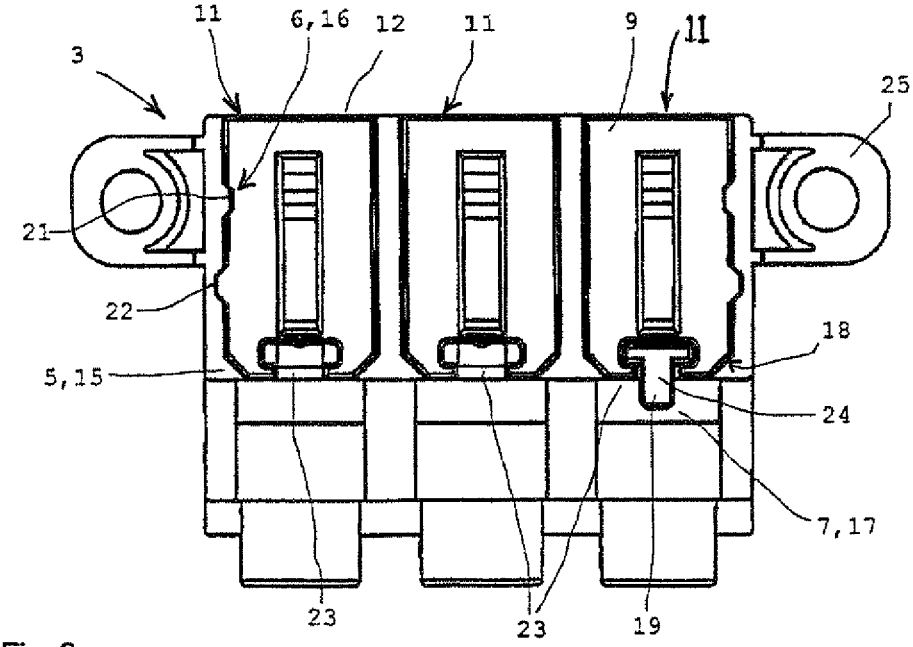
FIG. 2 the plug-in connector of FIG. 1.

The contact device illustrated in FIG. 2 has flanges 25 for screw-connecting the contact device 2 for example with the plug-in connector 3.

The coding contour device 15 comprises three towers 11 at the plug-in connector 3 each having a corresponding outer contour 12. Presently, coding chamfers 18 are provided at two of the corners of the overall approximately rectangular coding contour device 15.

Figure 3:
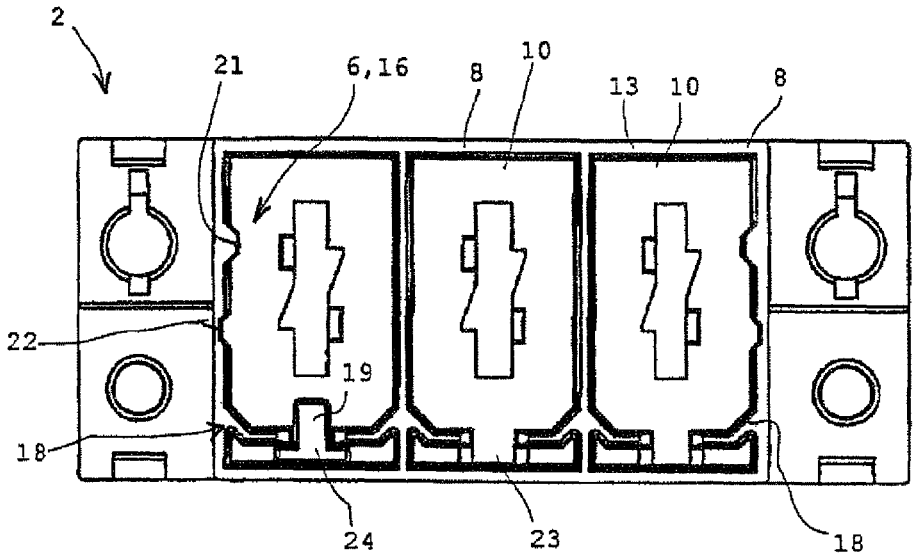
FIG. 3 a front view of the contact device according to FIG. 1.

FIG. 3 illustrates a front view of the contact device 2. One can clearly recognize the three coding devices 5-7 and 15-17 respectively which allow flexibility of coding.

Other than the coding profile device 17 with its coding chamfers 18, a key and keyway coding device 16 is provided having coding keyways 22 and corresponding coding keys 21. The key and keyway coding device allows flexibility of coding of the electric plug-in connection system 1 without requiring additional space. Furthermore the coding profile device 17 is provided wherein three coding sockets 23 are provided in the contact device 2 illustrated in FIG. 3 wherein only one coding socket 23 is provided with a coding profile 24. The coding profile 24 is pushed into a coding socket 23 with one leg 19 of the approximately T-shaped coding profile protruding outwardly out of the coding socket 23, thus effecting the coding desired.

Figure 4:
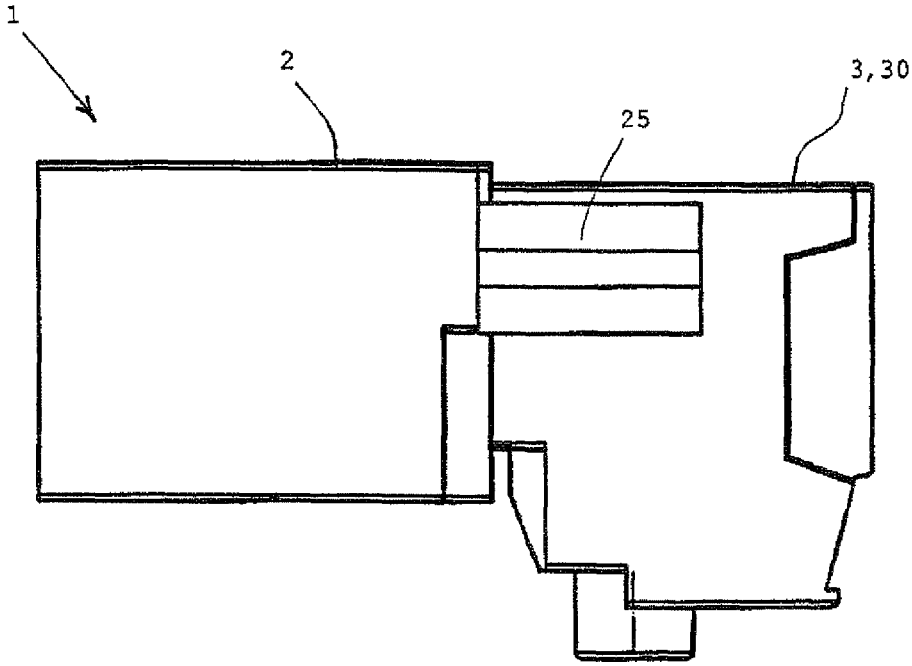
FIG. 4 the electric plug-in connecting system according to FIG. 1 in the connected position.

FIG. 4 illustrates a side view of the electric plug-in connecting system 1 wherein the contact device 2 establishes a firm connection with the plug-in connector 3. Optionally the flanges 25 may be provided with screws for connecting the contact device 2 with the plug-in connector 3.

Figure 5:
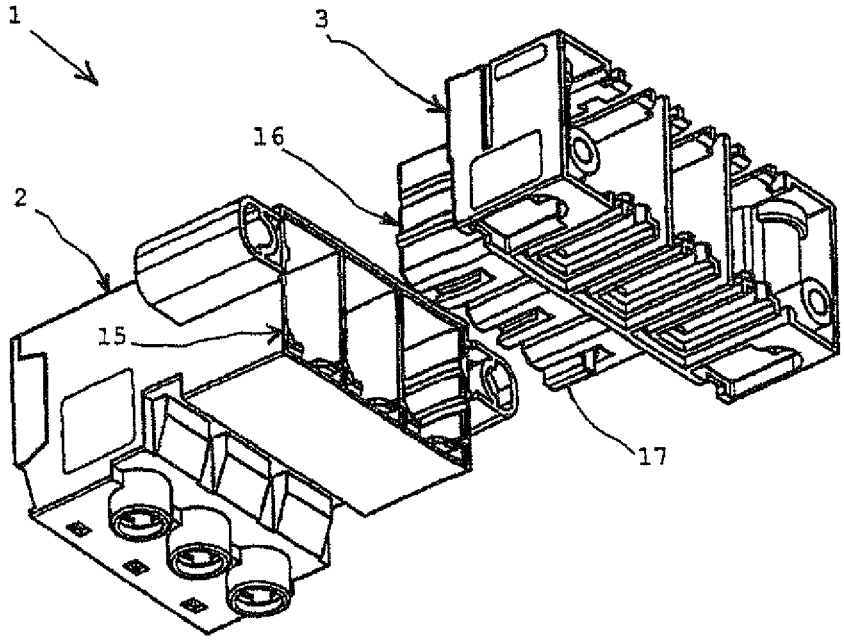
FIG. 5 another exemplary embodiment of the electric plug-in connecting system.
Figure 6:
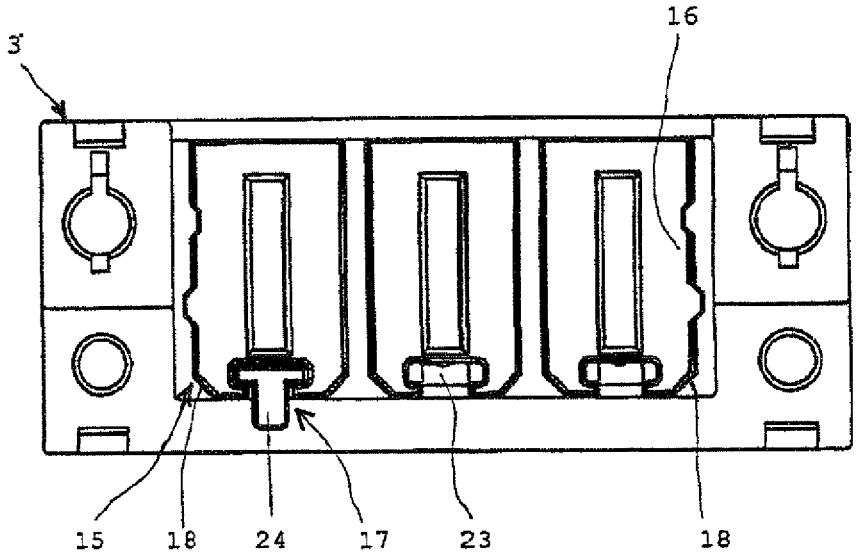
FIG. 6 the plug-in connector according to FIG. 5.

FIGS. 5 and 6 illustrate another embodiment wherein three coding devices 5, 6 and 7 or 15-17 are again provided. One of the coding devices is configured as a coding contour device 15 and another coding device 6 is realized as a key and keyway coding device 16. The third coding device 7 in the present exemplary embodiment is provided as a coding profile device 17. The coding contour device 15 comprises coding chamfers 18 at the tower 11 and the tower socket 10.

Unlike the exemplary embodiment according to the FIGS. 1-4 the exemplary embodiment according to the FIGS. 5 and 6 is provided with the contact device 2 as a plug 30 while the plug-in connector 3 is configured as a master strip 20.

The coding profiles 24 are available as accessories and may be retrofitted as needed.

On the whole the coding chamfers 18 of the coding contour device 15 prevent an unintentional insertion of the plug-in connector 3 into the contact device 2 rotated 180°.

The invention allows to provide an electric plug-in connecting system which is suitable for different electric currents and which via the coding reliably prevents a connection of plug-in connectors and contact devices provided for different electric currents, and in which contacting of different metallic surfaces can be avoided as well.

The invention claimed is:

1. An electric plug-in connecting system comprising:

a contact device including at least two tower sockets;

an electric plug-in connector including at least two projecting towers configured to be electrically connected to said at least two tower sockets of said contact device, and a coding system associated with said at least two tower sockets and said at least two projecting towers to avoid unintentional contacts, said coding system comprising at least three independent coding devices each configured for guiding connection of said at least two tower sockets and said at least two towers in a single orientation, two of said coding devices being on a wall forming said at least one tower socket and an outer wall of said at least one projecting tower; and the other of said coding devices inserted in said contact device or said connector in different orientations.

2. The electric plug-in connecting system according to claim 1, wherein the contact device is configured as a master strip.

3. The electric plug-in connecting system according to claim 1, wherein the plug-in connector is configured as a plug.

4. The electric plug-in connecting system according to claim 1, wherein said other of said coding devices is configured to be inserted in said contact device in a first orientation and inserted in said connector in a second, different orientation, which is 180 degrees from the first orientation.

5. The electric plug-in connecting system according to claim 1, wherein the coding system comprises a coding contour device as a coding device which is formed by mated, asymmetric housing geometries of the tower sockets of the contact device and of the towers of the electric plug-in connector.

6. The electric plug-in connecting system according to claim 5, wherein the tower sockets of the contact device and/or the towers of the plug-in connector are non-symmetric in contour.

7. The electric plug-in connecting system according to claim 5, wherein the towers of the plug-in connector are rectangular in their outer contour and have at least one coding chamfer.

8. The electric plug-in connecting system according to claim 1, wherein the coding system comprises at least one key and keyway coding device as the coding device.

9. The electric plug-in connecting system according to claim 8, wherein the key and keyway coding devices at the plug-in connector and at the contact device each comprise at least one coding key and one coding keyway.

10. The electric plug-in connecting system according to claim 8, wherein the key and keyway coding devices at the plug-in connector and at the contact device each comprise the same number of coding keys and coding keyways.

11. The electric plug-in connecting system according to claim 1, wherein the coding system comprises a coding profile device as the coding device comprising at least one coding socket and at least one exchangeable coding profile.

12. The electric plug-in connecting system according to claim 11, wherein two or more coding sockets and at least one coding profile are provided.

13. The electric plug-in connecting system according to claim 11, wherein at least one coding profile is configured T-shaped and wherein when installed as intended a leg of the T-shaped coding profile protrudes out of the coding socket.

14. An electric plug-in connecting system comprising:

a contact device including at least two contour receptacles; and an electric plug-in connector including at least two protruding keyways, said at least two protruding keyways and said at least two contour receptacles being configured to matingly engage each other, wherein each said at least two protruding keyways and said at least two contour receptacles include a coding system having at least three independent coding devices for guiding connection of said contact device and said plug-in connector in a single orientation, two of said coding devices being on a wail forming said at least two contour receptacles and an outer wall of said at least two protruding keyways; and the other of said coding devices being inserted in said receptacle or said connector in a first orientation relative to said receptacle or said connector, and a second, different orientation relative to said receptacle said connector.

* * * * *